United States Patent [19]

Woffendin

[11] Patent Number: 4,669,247

[45] Date of Patent: Jun. 2, 1987

[54] SPRING PACKING APPARATUS

[75] Inventor: Arnold Woffendin, Colne, England

[73] Assignee: Silentnight Holdings PLC, Colne, England

[21] Appl. No.: 795,737

[22] Filed: Nov. 5, 1985

Related U.S. Application Data

[63] Continuation of Ser. No. 497,133, May 23, 1983, abandoned.

[30] Foreign Application Priority Data

May 22, 1982 [GB] United Kingdom ..... 8214997

[51] Int. Cl.[4] ..... B65B 63/04

[52] U.S. Cl. ..... 53/116; 53/526; 242/67.1 R; 242/81

[58] Field of Search ..... 53/114, 116, 118, 119, 53/436, 439, 526, 528, 430; 242/81, 67.1 R

[56] References Cited

U.S. PATENT DOCUMENTS

| | | | |
|---|---|---|---|
| 2,114,008 | 4/1938 | Wunderlich | 53/118 X |
| 2,731,183 | 1/1956 | Shaw | 53/119 X |
| 2,973,607 | 3/1961 | Mosier | 53/116 X |
| 3,911,641 | 10/1975 | Miller et al. | 53/118 X |
| 3,964,232 | 6/1976 | Bender et al. | 53/118 X |
| 4,034,928 | 7/1977 | McDonald et al. | 242/67.1 R X |
| 4,139,163 | 2/1979 | Tabel et al. | 242/67.1 R X |
| 4,173,112 | 11/1979 | Meiners | 53/118 X |
| 4,245,829 | 1/1981 | Coast | 53/118 X |
| 4,494,359 | 1/1985 | Honegger . | |

FOREIGN PATENT DOCUMENTS

| | | |
|---|---|---|
| 2013631B | 3/1982 | United Kingdom . |
| 2092557B | 3/1985 | United Kingdom . |

*Primary Examiner*—Robert L. Spruill
*Assistant Examiner*—Steven P. Weihrouch
*Attorney, Agent, or Firm*—Woodard, Weikart, Emhardt & Naughton

[57] ABSTRACT

A machine for packing spring units in web material into the form of a roll comprises a winding mandrel. Conveyor means act against said mandrel from below so as to define therewith a bottom entry nip for spring units to be compressed and wound around the mandrel. Means exert pressure on the conveyor means in the direction of said mandrel.

11 Claims, 6 Drawing Figures

SPRING PACKING APPARATUS

This application is a continuation of application Ser. No. 497,133, filed 5-23-83 now abandoned.

This invention is concerned with improvements in or relating to spring packing machines and more particularly to a machine for packing a plurality of spring units in the form of a roll.

It is well known to pack spring units, e.g. Bonnell or open type spring units for use in making mattresses, by winding a length of flexible web material, e.g. disposable paper or re-usable hessian, around a mandrel and feeding the spring units successively into the nip between the growing roll and the travelling web material. The spring units are compressed and the resultant roll has a much reduced bulk as compared to conventionally stacked spring units.

A known machine for this purpose comprises a winding mandrel to which is bolted by its ends a holding bar for holding the leading end of the web material. An upwardly mobile pressure roller is mounted above the mandrel so as to define therewith an entry nip for the web material. The web material is fed from a reel supported at the rear of the machine, over the pressure roller and onto the mandrel. An operator standing at the front of the machine feeds spring units into the entry nip.

The known roll-packing machines of the kind described have a number of disadvantages. The nip into which the operator has to feed successive spring units is at the top of the mandrel at an increasing distance from the axis of the mandrel as the roll increases in diameter. The operator must therefore lift the spring units by a varying amount in order to present them to the nip. Furthermore, the mandrel has a constant peripheral speed with the result that as the roll increases in diameter the winding speed, i.e. the speed of travel of the web material and hence the rate of feed of the spring units, must be correspondingly increased. Also, before the mandrel can be retracted to release a finished roll, the holding bar must be unbolted and subsequently withdrawn from the roll and resecured to the mandrel. Finally, because the finished roll is released to the front of the machine, winding of another roll must wait on removal of the finished roll, repositioning of the mandrel and refitting of the holding bar, which operations take about as much time as the winding operation itself.

An object of the present invention is to provide a spring packing machine in which the above disadvantages are obviated or mitigated.

According to the present invention there is provided a machine for packing spring units in web material into the form of a roll, comprising a winding mandrel, conveyor means acting against said mandrel from below so as to define therewith a bottom entry nip for spring units to be compressed and wound around the mandrel, and means for exerting pressure on the conveyor means in the direction of said mandrel.

The invention will now be described by way of example only, with reference to the accompanying drawings, in which.

Figure 1:
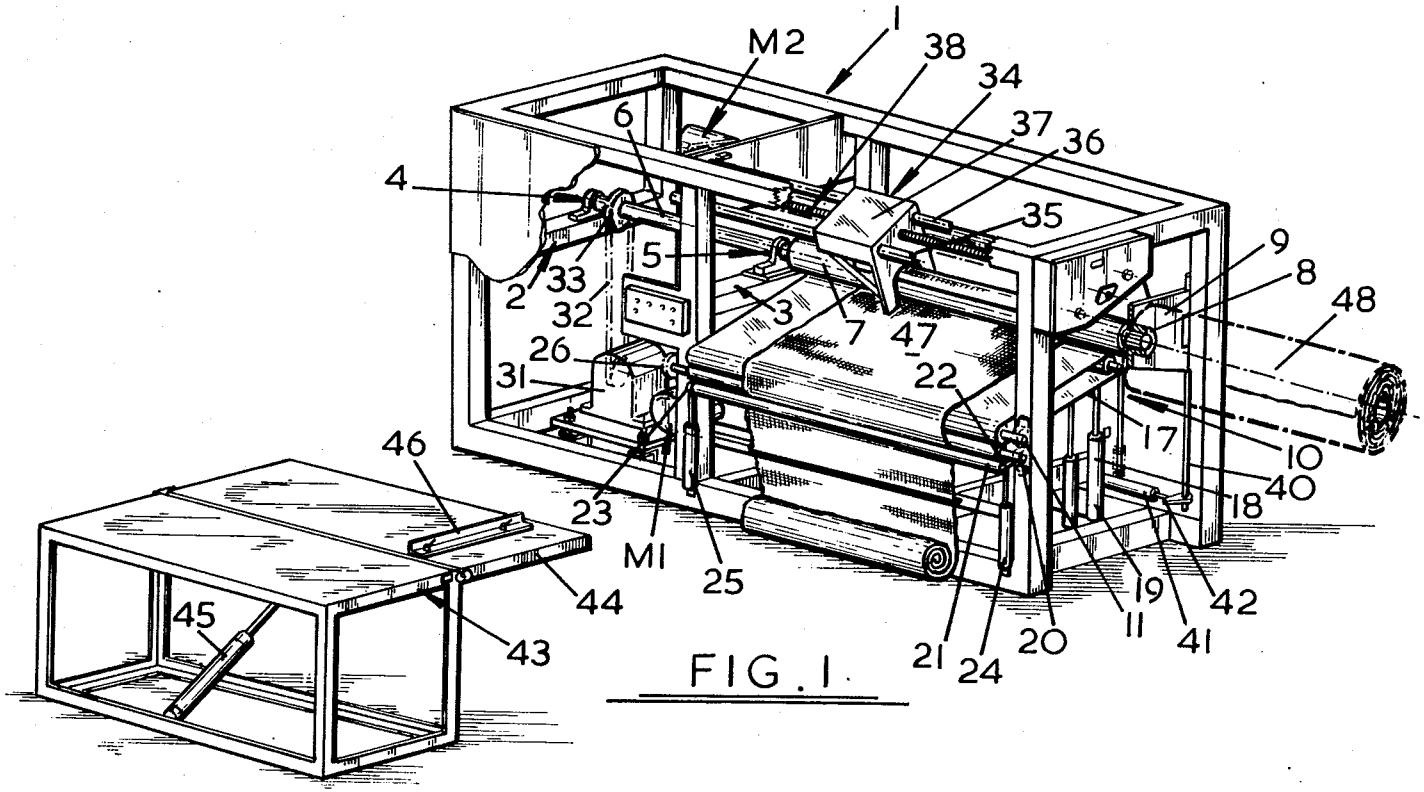
FIG. 1 is a perspective view of one embodiment of spring packing machine according to the invention.

Referring now to the drawings, the exemplary machine comprises a frame 1 with cross members 2, 3 supporting LH end and centre bearings 4, 5 respectively of a shaft 6 forming part of a winding mandrel 7. The RH end of the shaft 6 is supported in a split bearing 8 carried by swing doors of which only the rear door 9 is shown in FIG. 1.

Cooperating with the mandrel 7 is a belt unit 10 comprising rollers 11, 12, 13 and 14 rotatably mounted in side members 15, 16 at their RH ends, corresponding side members being provided but not shown at the LH ends. The belt unit 10 is mounted for pivotal movement about the axis of the front roller 11 which is in a fixed position relative to the machine frame 1. The two main side members 16 are L-shaped and the two rear rollers 13 and 14 are mounted at opposite ends of the short limb of each of said side members 16. The remaining roller 12 is mounted in floating relation to the side members 15 on the side members 16. A belt 17 is trained around the rollers 11, 12, 13 and 14. The side members 15, 16 are adapted to be raised and lowered by respective air cylinders 18, 19.

Below the front roller 11 of the belt unit 10 is mounted a pair of nipping rollers 20, 21. The upper nipping roller 20 is fixed and the lower roller 21 is mounted on swing links 22, 23 which are acted upon by air cylinders 24, 25 for pressing the lower roller 21 against the upper roller 20. The upper roller 20 is equipped with an adjustable disc brake 26 for restraining rotation thereof.

Figure 2:
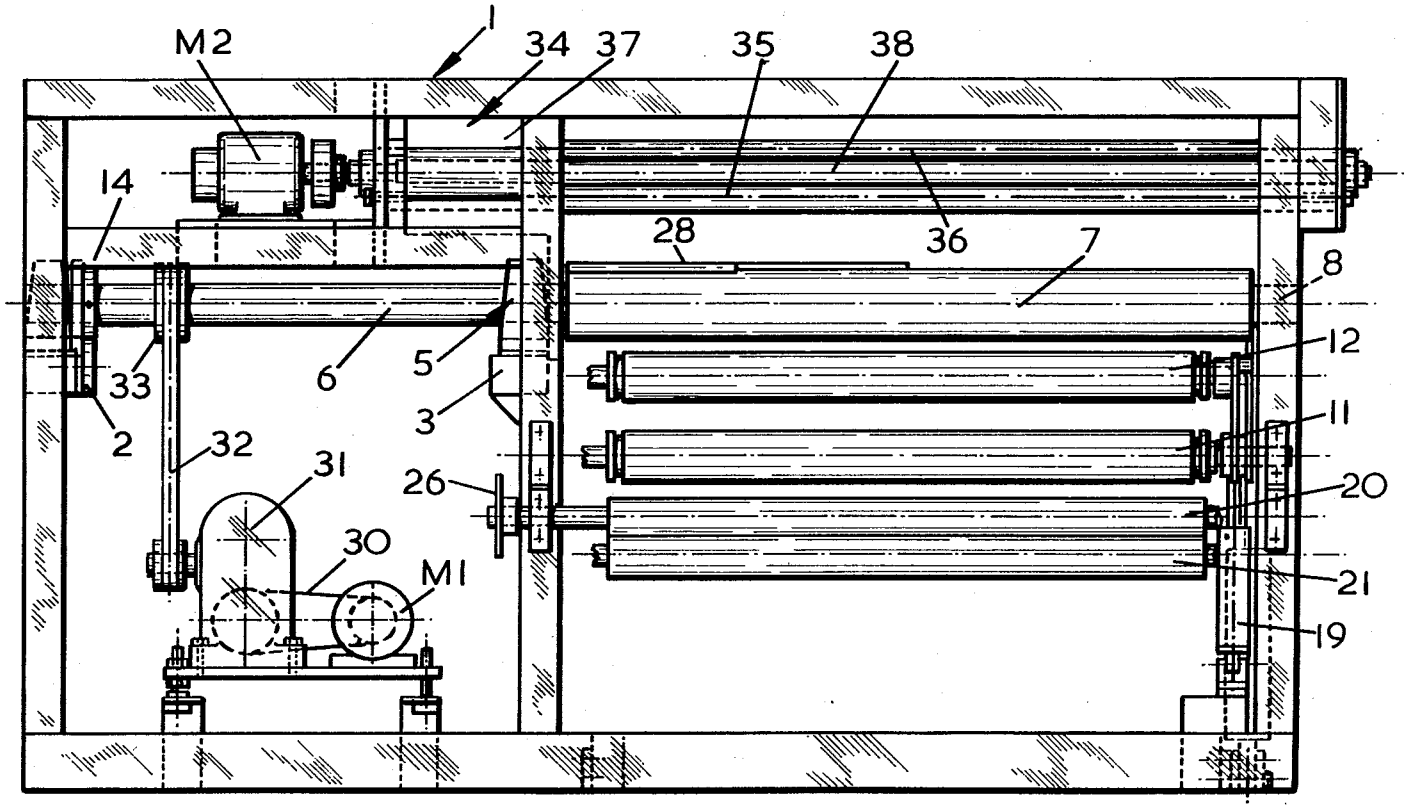
FIG. 2 is a front elevation of the machine of FIG. 1.
Figure 4:
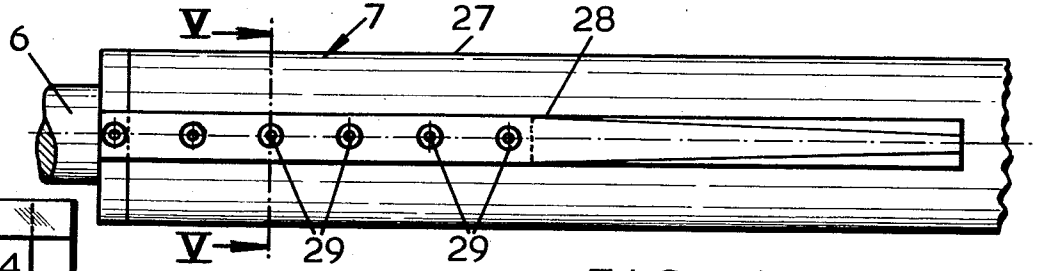
FIG. 4 is a plan view of part of the winding mandrel with holding bar.
Figure 6:
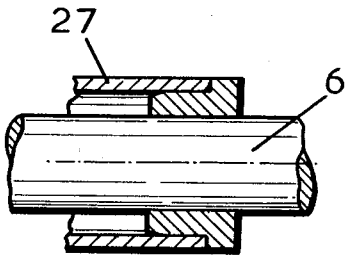
FIG. 6 is a longitudinal section of the right-hand end of the winding mandrel as seen in FIG. 2.
Figure 5:
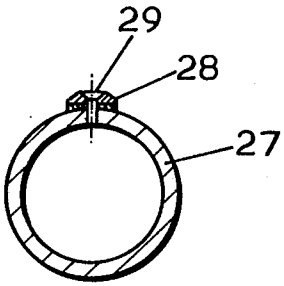
FIG. 5 is a cross section on line V—V in FIG. 4.

The winding mandrel 7 has a polished outer surface provided by a sleeve 27 fixed on the mandrel shaft 6 in coaxial relationship therewith. As seen particularly in FIGS. 2, 4 and 5 a holding bar 28 is mounted on the sleeve 27 and extends lengthwise thereof over approximately the LH half of the mandrel 7. The bar 28 is fastened to the sleeve 27 by countersunk screws 29 which are confined to the LH half of the bar so that the RH part thereof is cantilevered.

The mandrel shaft is driven by a variable speed DC motor $M_1$ through a transmission including a belt drive 30, reduction gearing 31 and a chain drive 32 terminating in a sprocket wheel 33 fixed to the LH end of the shaft 6.

A roll ejecting mechanism 34 is mounted above the mandrel 7. It comprises parallel guide rails 35, 36 on which a pusher 37 is slidably mounted. The pusher 37 is movable over the length of the mandrel 7 by means of a lead screw 38 driven by an AC motor $M_2$. As will be apparent from the description of the mode of operation of the machine a finished roll is ejected from the RH side of the machine and it is for this reason that the swing doors referred to above are provided. The door 9 shown in FIG. 1 is fixed to a vertical spindle 40 which is actuated by a cylinder 41 acting on a lever 42 fixed to the bottom end of the spindle. The missing door is constructed and operated in exactly the same way and need not be further described. The free vertical edge of each door carries a respective half of the split bearing 8 so that when the two doors are closed and bearing 8 journals the free end of the mandrel shaft 6.

At the front of the machine is a drop-leaf feed table 43 which is normally positioned as shown in dotted line with the leaf 44 thereof in close proximity to the front roller 11 of the belt unit 10. The leaf 44 is raised and lowered by means of a cylinder 45 and is equipped with an adjustable guide 46 for the purpose explained below.

Figure 3:
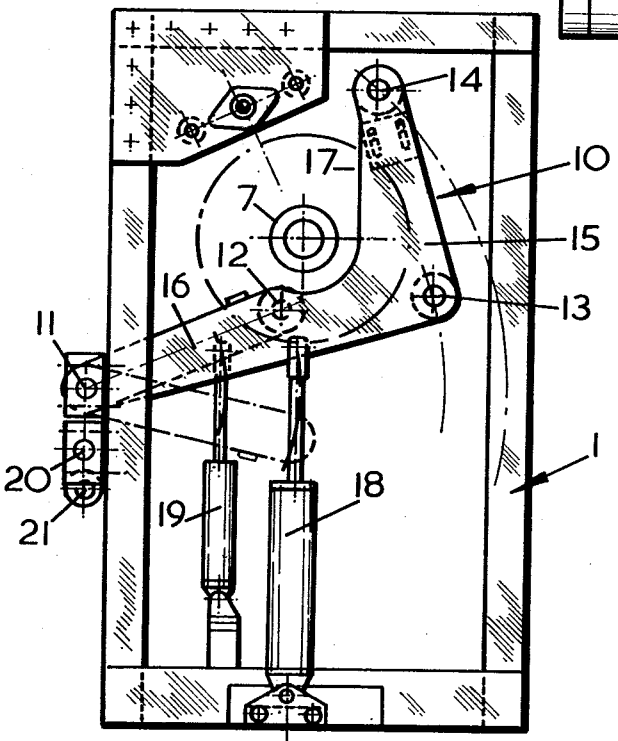
FIG. 3 is a side elevation.

The machine operation will now be described using a length of hessian 47 or like re-usable material which is held in a trough (not shown) near the floor at the front of the machine. The leading edge of the hessian 47 is fed between the nipping rollers 20, 21, over the belt unit 10 which at this stage is in the lowered position indicated in dotted line in FIG. 3. The leading edge is turned over at the LH corner and inserted under the cantilevered portion of the holding bar 28. The air cylinders 18, 19 are then operated to raise the belt unit 10 into the position shown in FIG. 1 and (in full line) in FIG. 3. The cylinder 19 acting on the side members 16 presses the roller 12 against the belt 17 so as to increase the force urging the belt against the mandrel. The pusher 37 is stowed in its LH position shown in FIG. 2. The air cylinders 24, 25 are operated to press the lower nipping roller 21 against the upper roller 20 and the disc brake 26 is adjusted as necessary for achieving the desired tension of the hessian 47.

In this start-up condition of the machine the leading portion of the hessian is supported on belt unit 10 which is urged upwardly to press the belt 17 against the mandrel 7 so defining an entry nip for spring units (not shown). The machine operator now switches on the machine so as to rotate the mandrel 7 downwardly as seen from the front of the machine. A spring unit (having the shape of a generally rectangular box) is fed into the nip in spaced relation to the running side edges of the hessian web 47. The spring unit is compressed by the interaction of the mandrel 7 and the belt unit 10 and wound around the mandrel 7 within a growing spiral of hessian web. As successive spring units are packed in this way the roll grows in diameter and the belt unit 10 is gradually lowered. In spite of variations in diameter of the roll and consequent lowering of the entry nip the spring units can be placed on the hessian as it travels to the nip. The belt 17 of the belt unit 10 is caused to move by the friction of the mandrel or roll and the arrangement thus provides an effective infeed conveyor for the hessian and the spring units. The speed of the motor $M_1$ may be reduced as the roll increases in diameter in order to ensure a constant feed rate of spring units to the nip.

The feed table 43 is used to position the spring units accurately before sliding them forwardly onto the travelling web 47. Adjustment of the web guide 46 by reference to the width of the spring units and the hessian facilitates accurate positioning of the spring units with respect to the hessian web.

When the length of hessian has all been wound onto the mandrel with the spring units to form a finished roll 48 also referred to as a "roll pack" the winding mandrel is stopped, the belt unit 10 lowered, the doors 9 opened and the motor $M_2$ operated to rotate the lead screw 38 and cause the pusher 37 to move to the right as seen in FIG. 1. The pusher 37 acts against the LH end of the finished roll so as to push it into the position shown in FIG. 1 from which it is removed e.g. by a travelling conveyor (not shown). The pusher 37 is then retracted by reverse rotation of the lead screw 38 whereupon the doors 9 are closed.

During movement of the pusher 37 in either direction the operator can use any free time to set up the machine for the next winding operation. The operations requiring to be performed will be obvious from the preceding description and it suffices to say that it is at this stage that the leaf 44 of the table 43 is lowered to give access to the foot of the front of the machine thereby facilitating positioning and threading of the hessian.

The hessian web used in the operation described above is of unit length in that it is intended to suffice for a single roll pack. It is also possible to provide the hessian or other re-usable material in continuous length on a reel. After winding a roll pack of predetermined diameter the web is cut before ejecting the pack. This poses certain problems when the cut lengths of material are returned although it has been proposed with known machines to re-unite these lengths in a preliminary sewing operation. Such problems do not arise when the web material is disposable e.g. paper. In either case, if a reel of material is used this is preferably mounted at the front of the table 43 and the web is fed upwardly and over the surface of the table 43 before passing between the nipping rollers 20, 21. The spring units may then be positioned directly on the web material as it travels over the table 43.

What is claimed is:

1. A machine for packing spring units in web material into the form of a roll, comprising:

a horizontal winding mandrel;

conveyor means extending substantially horizontally from a location forward of said winding mandrel at least to a location substantially vertically below said mandrel, and arranged for acting against said mandrel from below so as to define therewith at a location substantially vertically below said mandrel a front entry nip for receiving and compressing spring units to be compressed and wound around the mandrel;

means for exerting pressure on the conveyor means in a generally upward direction to effect initial compression of said spring units against said mandrel at the entry nip;

ejector means for ejecting a finished roll laterally from the machine, said ejector means including a guide means, a roll pusher movable along said guide means forwards and backwards along the mandrel, means for driving said pusher and means for supporting the winding mandrel at the ejection side of the machine in a manner permitting roll ejection; and, wherein the means for supporting comprises a split bearing with two bearing halves disposed diametrically opposite one another with respect to said mandrel, each bearing half supported in respective doors adapted to be opened to move each bearing half away from said mandrel to provide clearance to permit ejection of the roll.

2. A machine as claimed in claim 1, wherein the conveyor means is a belt guided around a plurality of idler rollers forming part of a unit arranged to be raised and lowered with respect to the mandrel.

3. The apparatus of claim 2 in which said machine includes a frame and a pair of mounting brackets mounted to said frame, said plurality of idler rollers including a first idler roller and a second idler roller, each of the first and second idler rollers being mounted at opposite ends to the opposed mounting brackets, said mounting brackets being pivotally attached to the frame to be pivotable about the axis of the first idler roller, the second idler roller being positioned closer than the first idler roller to the mandrel, said means for exerting pressure on the conveyor means including means for pivoting the mounting brackets in the direction of the mandrel, whereby the pivoting of the mounting brackets relative the mandrel exerts pressure of the belt extending over the first and second idler rollers against the mandrel and the spring units and web material wrapped about the mandrel.

4. A machine as claimed in claim 1, including guide means for guiding the web material to the winding mandrel, said guide means comprising a pair of nipping rollers arranged one above the other.

5. A machine as claimed in claim 4, wherein the upper of said nipping rollers is equipped with a brake and the lower roller is adapted to be movable towards and away from the upper roller.

6. A machine as claimed in claim 1, wherein the winding mandrel has a web material retaining bar extending at least partially over the length thereof substantially parallel to the axis of the mandrel in cantilever manner so as to enable the leading edge of the web material to be inserted between the retaining bar and the mandrel and removed axially therefrom without the need to dismount the bar from the mandrel.

7. The apparatus of claim 1 and which further includes spring feeding means for feeding spring units into and between the mandrel and the conveyor means, whereby the spring units and adjoining web material are compressed between the mandrel and the conveyor means and are wound about the mandrel with the spring units in the compressed condition.

8. A machine as claimed in claim 1, in which said conveyor means includes a continuous loop belt which extends from said location forward of said mandrel to a location below and rearwardly of said mandrel, and thence upwardly.

9. A machine as claimed in claim 8, in which said continuous loop belt is carried by a plurality of rollers fixed in an L-shaped configuration relative each other, and moveable as a unit relative said mandrel.

10. A machine as claimed in claim 9, in which said continuous loop belt is further carried by another roller movable relative said plurality of fixed configuration rollers.

11. A machine as claimed in claim 1, and further including web feeding means for feeding the web material between said conveyor means and said winding mandrel to be wound about the winding material, said spring units to be received between said web material and said winding mandrel.

* * * * *